United States Patent [19]

Papastavros

[11] 4,420,941

[45] Dec. 20, 1983

[54] COOLING SYSTEM

[76] Inventor: Demos Papastavros, 2429 NE. 184 Ter., N. Miami Beach, Fla. 33160

[21] Appl. No.: 493,229

[22] Filed: May 10, 1983

[51] Int. Cl.[3] ..... F25D 9/00

[52] U.S. Cl. ..... 62/402; 62/513

[58] Field of Search ..... 62/113, 172, 401, 402, 62/513

[56] References Cited

U.S. PATENT DOCUMENTS

| | | | |
|---|---|---|---|
| 3,321,930 | 5/1967 | LaFleur | 62/402 |
| 3,327,495 | 6/1967 | Ergenc | 62/401 |
| 3,355,903 | 12/1967 | LaFleur | 62/402 |
| 3,394,555 | 7/1968 | LaFleur | 62/402 |
| 3,696,637 | 10/1972 | Ness et al. | 62/402 |
| 4,326,391 | 4/1982 | Sato et al. | 62/402 |

*Primary Examiner*—Ronald C. Capossela

[57] ABSTRACT

A cooling system operated by a pair of turbines on the same drive shaft. Some of the hot exhaust fluid from both turbines goes through corresponding heat exchangers to a condenser and from the condenser back through these heat exchangers and a heater to inlets to the turbines. The remainder of the hot turbine exhaust fluid flows through a pressure regulating valve to an additional heat exchanger and from there through a condenser to several evaporators, which are connected in parallel, and from these evaporators through a pressure regulating valve back through the additional heat exchanger and a compressor to inlets to the turbines.

17 Claims, 2 Drawing Figures

THERM.
THERM.
THERM.
THERM.
FUEL

COOLING SYSTEM

SUMMARY OF THE INVENTION

This invention relates to a cooling system, such as for refrigerating food or for air conditioning, which uses turbines for recirculating refrigerant fluid through the successive stages of the vapor-compression refrigeration cycle.

A principal object of this invention is to provide a novel cooling system having one or more turbines for recirculating the refrigerant fluid.

Another object of this invention is to provide such a cooling system having a novel heat exchanger arrangement in which hot exhaust fluid from a turbine heats and compresses the refrigerant fluid returning to a turbine inlet.

Another object of this invention is to provide a novel cooling system which may have several evaporators for cooling different areas, such as different freezers in a supermarket.

Another object of this invention is to provide a novel cooling system having turbines and heat exchangers arranged in a novel manner for improved cooling efficiency and minimum energy consumption.

Further objects and advantages of this invention will be apparent from the following detailed description of a presently preferred embodiment, which is illustrated schematically in the accompanying drawing.

Preferably, the present cooling system comprises:

(1) two turbines mounted on the same shaft;

(2) a first heat exchanger having a first fluid passageway which receives hot exhaust fluid from the outlet of the first turbine;

(3) a second heat exchanger having a first fluid passageway which receives hot exhaust fluid from the outlet of the second turbine;

(4) fluid connections from the respective outlets of the first passageways in the first and second heat exchangers to the inlet of a first condenser;

(5) respective second passageways in the first and second heat exchangers connected between the outlet of the first condenser and one inlet of each turbine, so that the refrigerant fluid is heated and compressed in these second passageways before returning to this inlet of each turbine;

(6) a heater for further heating and compressing the refrigerant fluid between the respective second passageways of the first and second heat exchangers and the corresponding turbine inlets;

(7) a third heat exchanger having a first fluid passageway connected between the turbine outlets and the inlet of a second condenser; and (8) one or more thermostatically controlled expansion valves and evaporators connected between the outlet of the second condenser and a second fluid passageway in the third exchanger, where the fluid is heated before returning through a compressor to a second inlet of each turbine.

Figures 1, 2:
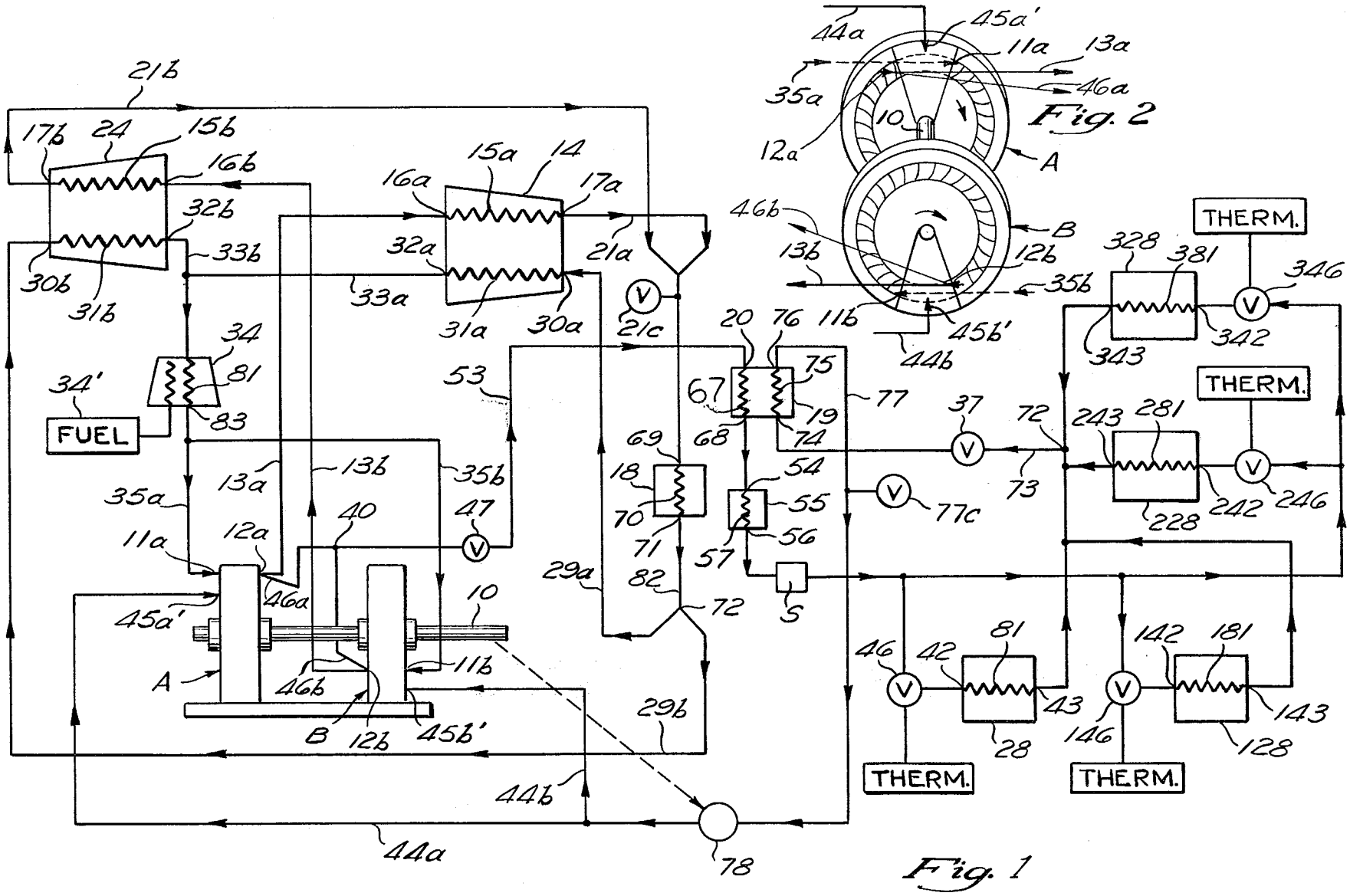
FIG. 1 shows schematically a cooling system in accordance with the present invention.
FIG. 2 shows schematically the two turbines in this system, each having two inlets and one outlet.

Before explaining the disclosed embodiment of the present invention in detail it is to be understood that the invention is not limited in its application to the details of the particular arrangement shown since the invention is capable of other embodiments. Also, the terminology used herein is for the purpose of description and not of limitation.

DETAILED DESCRIPTION

Referring to FIG. 1, two turbines A and B have their respective rotors mounted on the same rotary shaft 10 so that they rotate in unison.

The first turbine A has a first fluid inlet at 11*a* and a fluid outlet at 12*a* for passing the hot fluid exhaust from this turbine to a conduit 13*a* which leads to a first heat exchanger 14. This heat exchanger has a first fluid passageway arrangement indicated schematically at 15*a* with an inlet at 16*a* at one end connected to conduit 13*a* and an outlet 17*a* at the opposite end.

Outlet 17*a* of the first heat exchanger 14 is connected through a conduit 21*a* to the inlet 69 of a first condenser 18, which has a fluid passageway arrangement indicated schematically at 70 for conducting fluid from inlet 69 to an outlet 71.

The second turbine B has a first fluid inlet at 11*b* and a fluid outlet at 12*b* for passing the hot fluid exhaust from this turbine to a conduit 13*b* which leads to a second heat exchanger 24. This heat exchanger has a first fluid passageway arrangement indicated schematically at 15*b* with an inlet at 16*b* at one end connected to conduit 13*b* and an outlet 17*b* at the opposite end.

Outlet 17*b* of the second heat exchanger 24 is connected through a conduit 21*b* to the inlet 69 of the condenser 18. Thus, the fluid passageway arrangement 70 in the condenser 18 receives fluid from both the first fluid passageway arrangement 15*a* in the first heat exchanger 14 and the first fluid passageway arrangement 15*b* in the second heat exchanger 24. A relief valve 21*c* is connected just ahead of the condenser inlet 69 to relieve any excess fluid pressure which may develop or pass excess fluid to a storage tank (not shown).

The outlet 71 of the condenser 18 is connected through a conduit 82 to a junction point 72 where it can divide, some going via line 29*a* to the first heat exchanger 14 and the rest going via line 29*b* to the second heat exchanger 24.

Conduit 29*a* leads to the inlet 30*a* of a second fluid passageway arrangement 31*a* in the first heat exchanger 14. This second fluid passageway arrangement 31*a* passes its fluid in the opposite direction in heat exchanger 14 from the direction in which the hot discharge from the first turbine A flows through the first passageway arrangement 15*a* in heat exchanger 14. The fluid in the second fluid passageway arrangement 31*a* is heated by the hotter fluid flowing through the first fluid passageway arrangement 15*a* in this heat exchanger. The second fluid passageway arrangement 31*a* in the first heat exchanger 14 has an outlet 32*a* which is connected to a conduit 33*a* leading to a selectively operable heater 34 having a fuel supply 34' which may be turned on to raise the temperature of the fluid coming in, when desired.

Conduit 29*b* leads to the inlet 30*b* of a second fluid passageway arrangement 31*b* in the second heat exchanger 24. Passageway arrangement 31*b* passes its fluid in the opposite direction from the direction in which the hot discharge from the second turbine B flows through the first passageway arrangement 15*b*. The fluid in passageway 31*b* is heated by the hotter fluid in passageway 15*b*. The second fluid passageway arrangement 31*b* in the second heat exchanger 24 has an outlet 32*b* which is connected to a conduit 33*b* leading to heater 34.

Conduits 33*a* and 33*b* are both connected to a fluid passageway arrangement 81 in heater 34 which has an outlet at 83. If desired, a compressor (not shown) may be connected between conduits 33*a* and 33*b* and the passageway 81 in heater 34. From the heater outlet 83 the heated fluid divides, some going via conduit 35*a* to the first inlet 11*a* of turbine A and the rest going via conduit 35*b* to the first inlet 11*b* of turbine B.

The system has a third heat exchanger 19 with a first fluid passageway arrangement 67 for conducting hot turbine exhaust fluid from an inlet 20 to an outlet 68. The outlet 12*a* of turbine A is connected via a conduit 46*a* to a junction 40, and the outlet 12*b* of turbine B is connected via a conduit 46*b* to this same junction. From junction 40 the hot exhaust from both turbines flows through a pressure regulating valve 47 to a conduit 53 leading to inlet 20 of the third heat exchanger 19.

From the outlet 68 of the first fluid passageway arrangement 67 in the third heat exchanger 19 the fluid flows to a condenser 55 having a fluid passageway arrangement 57 with an inlet 54 (connected to the heat exchanger outlet 68) and an outlet 56. From this outlet the fluid flows through a strainer S to one or more evaporators, here shown as four evaporators 28, 128, 228 and 328, although any desired number may be provided. The outlet of condenser 55 is connected to the inlets of fluid passageway arrangements in the respective evaporators through corresponding thermostatically controlled expansion valves 46, 146, 246 and 346 and low pressure capillary tubes. The fluid passageway arrangements in the evaporators are designated 81, 181, 281 and 381, respectively, their respective inlets are designated 42, 142, 242 and 342, and their outlets are designated 43, 143, 243 and 343, respectively.

The evaporator outlets are all connected at a junction 72 to a conduit 73 leading to the inlet of a pressure regulating valve 37. The outlet of this valve is connected to the inlet 74 of a second fluid passageway arrangement 75 in the third heat exchanger 19. Valve 37 is open only when its inlet pressure in conduit 73 exceeds a predetermined value. Fluid flows through the second passageway arrangement 75 in the opposite direction to its flow through the first passageway arrangement 67 in the third heat exchanger 19. The second fluid passageway arrangement 75 has an outlet 76 connected via a conduit and compressor 78 to branch lines 44*a* and 44*b* leading to second inlets 45*a*′ and 45*b*′ of turbines A and B, respectively. A valve 77*c* is connected to conduit 77 to relieve any excess fluid pressure in this conduit or pass excess fluid from this conduit to a storage tank (not shown) or add fluid to conduit 77.

As shown in FIG. 2, in turbine A the fluid entering the first inlet 11*a* (from line 35*a* in FIG. 1) causes the turbine to rotate clockwise. The outlet 12*a* is located more than 300 degrees clockwise from the inlet. In the several degrees clockwise from outlet 12*a* to first inlet 11*a* there is a partial vacuum. The second inlet 45*a*′ is in this area of partial vacuum, and the vacuum here draws fluid into the turbine at inlet 45*a*′.

Similarly, in turbine B in the several degrees circumferentially between the outlet 12*b* and the first inlet 11*b* there is an area of partial vacuum to which the second inlet 45*b*′ is connected.

In each of the heat exchangers 14, 24 and 19, the first fluid passageway arrangement preferably has several laterally spaced passages connected in parallel and the second fluid passageway arrangement has several parallel passages which fit between the passages of the first fluid passageway arrangement for maximum heat transfer.

In the fluid passageway loop for turbine A, conduits 13*a*, 33*a* and 35*a* are of substantially larger diameter than conduits 21*a* and 29*a* because the fluid is at higher temperature in the former. For the same reason in the fluid passageway loop for turbine B conduits 13*b*, 33*b* and 35*b* are substantially larger in diameter than conduits 21*b* and 29*b*.

The fluid used in the system is a suitable refrigerant fluid, such as "Freon" or ammonia.

OPERATION

In the operation of this system, the hot fluid exhaust from turbine A enters the first fluid passageway 15*a* in the first heat exchanger 14 and gives up heat to the turbine fluid flowing through the second fluid passageway 31*a* in this heat exchanger. After leaving the first heat exchanger 14 through outlet 17*a* the turbine A exhaust fluid (its temperature having been reduced in the first heat exchanger 14) enters the fluid passageway 70 in the condenser 18.

The hot fluid exhaust from turbine B enters the first fluid passageway 15*b* in the second heat exchanger 24 and gives up heat to the turbine fluid flowing through the second fluid passageway 31*b* in this heat exchanger. After leaving the second heat exchanger through outlet 17*b* the turbine B exhaust fluid (its temperature having been reduced in the second heat exchanger 24) enters the fluid passageway 70 in the condenser 18, where it mixes with the turbine A fluid.

In the condenser 18 the combined fluid gives up heat to the environment and becomes compressed to its liquid state. On the outlet side of the condenser 18 the liquified fluid flows via lines 29*a* and 29*b* to the second fluid passages 31*a* and 31*b* in the first and second heat exchangers 24 and 14, respectively, where they are heated by the hot turbine exhaust in the respective first passageways 15*a* and 15 *b* of these heat exchangers. From the outlets 32*a* and 32*b* of these heat exchangers the respective fluids both flow into passageway 81 in heater 34, where the fluid may be heated before flowing through conduits 35*a* and 35*b* to the turbine inlets 11*a* and 11*b*.

The second condenser 55 receives fluid from both turbines A and B via the first fluid passageway arrangement 67 in third heat exchanger 19. This fluid flows through strainer S to the four evaporators 28, 128, 228 and 328 via respective thermostatically controlled valves 46, 146, 246 and 346. Each evaporator and its thermostat valve is connected in parallel with the others, so that the fluid coming from the strainer S divides among the evaporators whose thermostat valves open at that time. The refrigerant fluid boils in the evaporator, absorbing heat from the atmosphere, and then it flows in a low pressure gaseous state through pressure regulating valve 37 to the second passageway 75 in the third heat exchanger 19, where it absorbs heat from the hot turbine exhaust fluid in the first passageway 67 before returning via compressor 78 and conduits 44*a* and 44*b* to the respective second turbine inlets 45*a*′ and 45*b*′.

The evaporators 28, 128, 228 and 328 may be at different areas to be cooled, such as different freezers in a supermarket.

In this system the turbine fluid which flows through the first and second heat exchangers 14 and 24, the first condenser 18 and heater 34 enters the turbine inlets 11*a* and 11*b* at high enough pressure to drive the turbines and reduce the load on the electric motor or other prime mover which drives the turbine shaft 10. Under certain operating conditions, this prime mover will be disconnected from shaft 10 after the turbines have started running, in which case the turbines would continue to rotate under the force supplied by the recirculated turbine fluid coming in at inlets 11*a* and 11*b*, provided the heater 34 is operated to heat this recirculated fluid to the pressure required to drive the turbine.

If desired, the system may be simplified by eliminating one of the turbines A or B and the corresponding heat exchanger 14 or 24.

I claim:

1. In a cooling system having condenser means having an inlet and an outlet;

and evaporator means having an inlet operatively connected to said condenser means to receive refrigerant fluid therefrom and cause said fluid to boil, said evaporator means having an outlet;

the combination of:

a turbine having fluid inlet and outlet means;

a first heat exchanger having a first fluid passageway arrangement operatively connected to receive hot turbine exhaust fluid from said turbine outlet means;

a condenser operatively connected to receive fluid from said first passageway arrangement in said first heat exchanger;

said first heat exchanger having a second fluid passageway arrangement operatively connected to receive fluid from said last-mentioned condenser, said second fluid passageway arrangement being in heat exchange relationship to said first fluid passageway arrangement in said first heat exchanger;

a heater operatively connected between said second fluid passageway arrangement in said first heat exchanger and said turbine inlet means to heat fluid returning to the latter from said second fluid passageway arrangement in said first heat exchanger;

an additional heat exchanger having a first fluid passageway arrangement operatively connected between said turbine outlet means and the inlet of said first-mentioned condenser means, said additional heat exchanger having a second fluid passageway arrangement operatively connected to receive fluid from the outlet of said evaporator means, said second fluid passageway arrangement in said additional heat exchanger being in heat exchanger relationship to said first fluid passageway arrangement therein;

and a compressor operatively connected between the outlet of said second fluid passageway arrangement in said additional heat exchanger and said turbine inlet means to compress fluid returning to the turbine from said additional heat exchanger.

2. A cooling system according to claim 1, wherein the fluid flow in said second fluid passageway arrangement in each heat exchanger is opposite to the fluid flow in said first fluid passageway arrangement in the same heat exchanger.

3. A cooling system according to claim 1, and further comprising a pressure regulating valve connected between the outlet of said evaporator means and said second fluid passageway arrangement in said additional heat exchanger.

4. A cooling system according to claim 1, wherein said evaporator means comprises a plurality of evaporators connected in parallel with each other between said first-mentioned condenser means and the inlet of said second fluid passageway arrangement in said additional heat exchanger.

5. A cooling system according to claim 4, and further comprising a pressure regulating valve connected between the outlets of said evaporators and said second fluid passageway arrangement in said additional heat exchanger.

6. A cooling system according to claim 1, and further comprising a pressure regulating valve connected between said turbine outlet means and said first fluid passageway arrangement in said additional heat exchanger.

7. In a cooling system having condenser means having an inlet and an outlet;

and evaporator means having an inlet operatively connected to said condenser means to receive refrigerant fluid therefrom and cause said fluid to boil, said evaporator means having an outlet;

the combination of:

first and second turbines having respective fluid inlets and outlets;

first, second and third heat exchangers, each having a first fluid passageway arrangement with an inlet and an outlet and a second fluid passageway arrangement with an inlet and an outlet, said first and second fluid passageway arrangements in each heat exchanger being in heat exchange relationship to one another;

fluid conduit means operatively connecting the outlet of said first turbine to the inlet of said first fluid passageway arrangement in said first heat exchanger;

fluid conduit means operatively connecting the outlet of said second turbine to the inlet of said first fluid passageway arrangement in said second heat exchanger;

a condenser having an inlet and an outlet;

fluid conduit means operatively connecting the outlet of said first fluid passageway arrangement in said first heat exchanger and the outlet of said first fluid passageway arrangement in said second heat exchanger to the inlet of said last-mentioned condenser;

means operatively connecting the outlet of said last-mentioned condenser to the inlet of said second fluid passageway arrangement in said first heat exchanger and to the inlet of said second fluid passageway arrangement in said second heat exchanger;

means operatively connecting the outlet of said second fluid passageway arrangement in said first heat exchanger and the outlet of said second fluid passageway arrangement in said second heat exchanger to inlets of the respective turbines;

fluid conduit means operatively connecting the outlets of both turbines to the inlet of said first fluid passageway arrangement in said third heat exchanger;

fluid conduit means connecting the outlet of said first fluid passageway arrangement in said third heat exchanger to the inlet of said condenser means;

fluid conduit means operatively connecting the outlet of said evaporator means to the inlet of said second fluid passageway arrangement in said third heat exchanger;

and a compressor having an inlet operatively connected between the outlet of said second passageway arrangement in said third heat exchanger and inlets of the respective turbines.

8. A cooling system according to claim 7, and further comprising a pressure regulating valve connected between the outlets of both turbines and the inlet of said first fluid passageway arrangement in said third heat exchanger.

9. A cooling system according to claim 7, wherein the fluid flow in said second fluid passageway arrangement in each heat exchanger is opposite to the fluid flow in said first fluid passageway arrangement in the same heat exchanger.

10. A cooling system according to claim 9, and further comprising a heater for heating the fluid returning from the respective second fluid passageway arrangements in said first and second heat exchangers to the turbine inlets.

11. A cooling system according to claim 7, and further comprising a pressure regulating valve operatively connected between the outlet of said evaporator means and said second fluid passageway arrangement in the third heat exchanger.

12. A cooling arrangement according to claim 11, wherein the fluid flow in said second passageway arrangement in each heat exchanger is opposite to the fluid flow in said first fluid passageway arrangement in the same heat exchanger.

13. A cooling system according to claim 12, and further comprising a heater operatively connected between outlet of the second fluid passageway arrangement in each of said first and second heat exchangers and the turbine inlets for heating the fluid returning to the turbine inlets.

14. A cooling system according to claim 13, and further comprising a pressure regulating valve connected between the outlets of both turbines and the inlet of said first fluid passageway arrangement in said third heat exchanger.

15. A cooling system according to claim 7, wherein said evaporator means comprises a plurality of evaporators connected in parallel with each other between said first-mentioned condenser means and the inlet of said second fluid passageway arrangement in said third heat exchanger.

16. A cooling system according to claim 15, and further comprising a pressure regulating valve connected between the outlets of said evaporators and said second fluid passageway arrangement in said third heat exchanger.

17. A cooling system according to claim 16, wherein the fluid flow in said second fluid passageway arrangement in each heat exchanger is opposite to the fluid flow in said first fluid passageway arrangement in the same heat exchanger.

* * * * *